US005839947A

United States Patent [19]

Kimura et al.

[11] Patent Number: 5,839,947

[45] Date of Patent: Nov. 24, 1998

[54] POLISHING APPARATUS

[75] Inventors: Norio Kimura, Fujisawa; Kunihiko Sakurai, Yokohama; Tetsuji Togawa, Chigasaki; Seiji Katsuoka, Atsugi; Toyomi Nishi, Yokohama, all of Japan

[73] Assignee: Ebara Corporation, Tokyo, Japan

[21] Appl. No.: 795,511

[22] Filed: Feb. 5, 1997

[30] Foreign Application Priority Data

Feb. 5, 1996 [JP] Japan ..... 8-044199
Mar. 19, 1996 [JP] Japan ..... 8-090569

[51] Int. Cl.[6] ..... B24B 5/00; B24B 29/00

[52] U.S. Cl. ..... 451/288; 451/287

[58] Field of Search ..... 451/285, 286, 451/287, 288, 289, 41, 290, 36

[56] References Cited

U.S. PATENT DOCUMENTS

| | | | |
|---|---|---|---|
| 4,193,226 | 3/1980 | Gill, Jr. et al. . | |
| 4,607,496 | 8/1986 | Nagaura | 451/288 |
| 4,892,669 | 1/1990 | Marcora et al. . | |
| 5,329,732 | 7/1994 | Karlsrud et al. | 451/290 |
| 5,333,413 | 8/1994 | Hashimoto | 451/290 |
| 5,384,986 | 1/1995 | Hirose et al. | 451/444 |
| 5,455,080 | 10/1995 | Ooij | 427/470 |
| 5,491,185 | 2/1996 | Hegedus et al. | 523/451 |
| 5,498,481 | 3/1996 | Ooij | 428/413 |
| 5,527,424 | 6/1996 | Mullins . | |
| 5,545,076 | 8/1996 | Yun et al. | 451/287 |
| 5,578,529 | 11/1996 | Mullins | 451/287 |
| 5,616,063 | 4/1997 | Okumura et al. | 451/1 |
| 5,643,067 | 7/1997 | Katsuoka et al. | 451/287 |
| 5,651,725 | 7/1997 | Kikuta et al. | 451/286 |
| 5,653,623 | 8/1997 | Kimura et al. | 451/290 |

FOREIGN PATENT DOCUMENTS

| | | |
|---|---|---|
| 0 750 968 | 1/1997 | European Pat. Off. . |
| 32 43 617 | 5/1984 | Germany . |

*Primary Examiner*—Timothy V. Eley
*Assistant Examiner*—Derris H. Banks
*Attorney, Agent, or Firm*—Wenderoth, Lind & Ponack, L.L.P.

[57] ABSTRACT

A polishing apparatus is used for polishing a workpiece such as a semiconductor wafer to a flat mirror finish. The polishing apparatus includes a turntable having a polishing surface thereon, a top ring, for holding a workpiece to be polished and pressing the workpiece against the polishing surface, which is movable between a polishing position inside of the turntable and a standby position outside of the turntable, and a first device for keeping at least a lower surface of the top ring wet while the top ring is in the standby position. The polishing apparatus further includes a dressing tool for dressing the polishing surface on the turntable, and a second device for keeping at least a lower surface of the dressing tool wet while the dressing tool is in a standby position.

14 Claims, 6 Drawing Sheets

POLISHING APPARATUS

BACKGROUND OF THE INVENTION

1. Field of the Invention

The present invention relates to a polishing apparatus for polishing a workpiece such as a semiconductor wafer by pressing the workpiece held by a top ring against a turntable having a polishing surface thereon, and more particularly to a polishing apparatus which is capable of keeping the top ring and a dressing tool wet while the top ring and the dressing tool are held in respective standby positions outside of the turntable.

2. Description of the Related Art

Recent rapid progress in semiconductor device integration demands smaller and smaller wiring patterns or interconnections and also narrower spaces between interconnections which connect active areas. One of the processes available for forming such interconnection is photolithography. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus, which process is called Chemical Mechanical polishing.

Conventionally, a polishing apparatus has a turntable and a top ring which rotate at respective individual speeds. A polishing cloth is attached to the upper surface of the turntable. A semiconductor wafer to be polished is placed on the polishing cloth and clamped between the top ring and the turntable. An abrasive liquid containing abrasive grains is supplied onto the polishing cloth and retained on the polishing cloth. During operation, the top ring exerts a certain pressure on the turntable, and the surface of the semiconductor wafer held against the polishing cloth is therefore polished by a combination of chemical polishing and mechanical polishing to a flat mirror finish while the top ring and the turntable are rotated.

After, for example, one or more semiconductor wafers have been polished, the polishing cloth is processed to recover its original polishing capability. Various processes have been and are being developed for restoring the polishing cloth, and are collectively called "dressing". The polishing cloth is dressed in order to enable the polishing apparatus to perform a good polishing function at all times without undesired degradation of a polishing performance.

Next, a conventional polishing apparatus will be described below with reference to FIG. 6.

As shown in FIG. 6, the polishing apparatus has a turntable 100, a top ring unit 110, and a dressing tool unit 120. The top ring unit 110 and the dressing tool unit 120 are disposed above the turntable 100.

The turntable 100 is rotatable about its own axis by a drive shaft 101 connected thereto. A polishing cloth 102 made of polyurethane form, nonwoven fabric or the like is attached to an upper surface of the turntable 100.

The top ring unit 110 has a top ring 111 fixed to a lower end of a top ring drive shaft 115 which is rotated about its own axis by a motor 112 through a belt 113. The top ring 111 is connected to a vacuum source (not shown) through a pipe 117 and an internal passage defined in the top ring drive shaft 115 for attracting a semiconductor wafer (not shown) to a lower surface of the top ring 111 under vacuum.

The dressing tool unit 120 has a dressing tool 121 fixed to a lower end of a dressing tool drive shaft 125 which is rotated about its own axis by a motor 122 through a belt 123. The dressing tool 121 for dressing the polishing cloth 102 on the turntable 100 has a brush on a lower surface thereof. The brush may be replaced with a diamond grain layer containing diamond grains, depending on the property of the polishing cloth 102.

The top ring unit 110 and the dressing tool unit 120 are angularly movably supported by respective supporting shafts 131 and 141. The top ring drive shaft 115 and the dressing tool drive shaft 125 are vertically movable by air cylinders 152 and 172, respectively, and are rotatably supported by bearings.

In operation, the top ring 111 which holds a semiconductor wafer on its lower surface is moved above the turntable 100, and lowered by the top ring drive shaft 115, thereby pressing the semiconductor wafer against the polishing cloth 102 on the turntable 100. The turntable 100 and the top ring 111 are independently rotated by the drive shaft 101 and the top ring drive shaft 115 at respective speeds for thereby polishing the lower surface of the semiconductor wafer. At this time, an abrasive liquid is being supplied from a supply pipe 150 onto the polishing cloth 102.

After the semiconductor wafer is polished, the dressing tool 121 is moved above the turntable 100, and lowered and pressed against the polishing cloth 102 on the turntable 100 by the dressing tool driving shaft 125. The turntable 100 and the dressing tool 121 are independently rotated by the drive shaft 101 and the dressing tool drive shaft 125 at respective speeds for thereby dressing the surface of the polishing cloth 102. At this time, a dressing liquid such as pure water (deionized water) is being supplied from a supply pipe (not shown) onto the polishing cloth 102.

In the polishing apparatus shown in FIG. 6, the top ring 111 and the dressing tool 121 are swingable about the supporting shafts 131 and 141, respectively so that the top ring 111 and the dressing tool 121 are positioned in respective standby positions outside of the turntable 100.

When the top ring 111 is held in the standby position for maintenance and the dressing tool 121 is held in the standby position, they are not kept wet. Therefore, any slurry attached to the top ring 111 and the dressing tool 121 is dried. When the top ring 111 and the dressing tool 121 are moved to a position over the turntable 100, the dry slurry tends to fall onto the polishing cloth 102 on the turntable 100, thus adversely affecting the polishing the workpiece to be polished.

Further, the top ring drive shaft 115 and the dressing tool drive shaft 125 need to have bearing surfaces which are rotatably supported by the bearings. Therefore, it is necessary that the top ring drive shaft 115 and the dressing tool drive shaft 125 be made of a hardened SUS440C. Since the top ring drive shaft 115 and the dressing tool drive shaft 125 are hardened, their antirust properties are reduced.

The top ring drive shaft 115 and the dressing tool drive shaft 125 are positioned for exposure to the abrasive liquid and pure water, thus the abrasive liquid and pure water tend to be attached to the top ring drive shaft 115 and the dressing tool drive shaft 125. When the abrasive liquid and pure water are attached to the top ring drive shaft 115 and the dressing tool drive shaft 125, they will develop rust on their surfaces.

The top ring drive shaft 115 and the dressing tool drive shaft 125 may be plated with chromium for preventing rust from being developed thereon. However, the plated layer of chromium may possibly be peeled off, resulting in a chromium contamination in the semiconductor fabrication process.

Alternatively, the top ring drive shaft 115 and the dressing tool drive shaft 125 may be made of a ceramic material for preventing rust from being developed thereon. However, since ceramic materials are expensive, the manufacturing cost of the polishing apparatus increases.

SUMMARY OF THE INVENTION

It is therefore an object of the present invention to provide a polishing apparatus which is capable of keeping a top ring and a dressing tool wet with a cleaning liquid while the top ring and the dressing tool are held in respective standby positions outside of a turntable, for thereby removing any slurry that has been attached to the top ring and the dressing tool and preventing the top ring and the dressing tool from being dried.

Another object of the present invention is to provide a polishing apparatus which can effectively prevents a top ring drive shaft and/or a dressing tool drive shaft from developing rust.

According to one aspect of the present invention, there is provided a polishing apparatus comprising: a turntable having a polishing surface thereon; a top ring for holding a workpiece to be polished and pressing the workpiece against the polishing surface on the turntable, the top ring being movable between a polishing position inside of the turntable and a standby position outside of the turntable; and a first device for keeping at least a lower surface of the top ring wet while the top ring is in the standby position.

The polishing apparatus further comprises: a dressing tool for dressing the polishing surface on the turntable, the dressing tool being movable between a dressing position inside of the turntable and a standby position outside of the turntable; and a second device for keeping at least a lower surface of the dressing tool wet while the dressing tool is in the standby position.

According to another aspect of the present invention, there is provided a polishing apparatus comprising: a turntable having a polishing surface thereon; a top ring for holding a workpiece to be polished and pressing the workpiece against the polishing surface; an abrasive liquid supply device for supplying an abrasive liquid to the polishing surface on the turntable; and a top ring drive shaft for rotating the top ring, the top ring drive shaft having a lower portion where the abrasive liquid tends to be applied, at least the lower portion being coated with a wear-resistant synthetic resin.

The polishing apparatus further comprises: a dressing tool for dressing the polishing surface on the turntable; a dressing liquid supply device for supplying a dressing liquid to the polishing surface on the turntable; and a dressing tool drive shaft for rotating the dressing tool, the dressing tool drive shaft having a lower portion where the dressing liquid tends to be applied, at least the lower portion being coated with a wear-resistant synthetic resin.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

A polishing apparatus according to a first embodiment of the present invention will be described below with reference to FIGS. 1 through 3.

Figure 1:
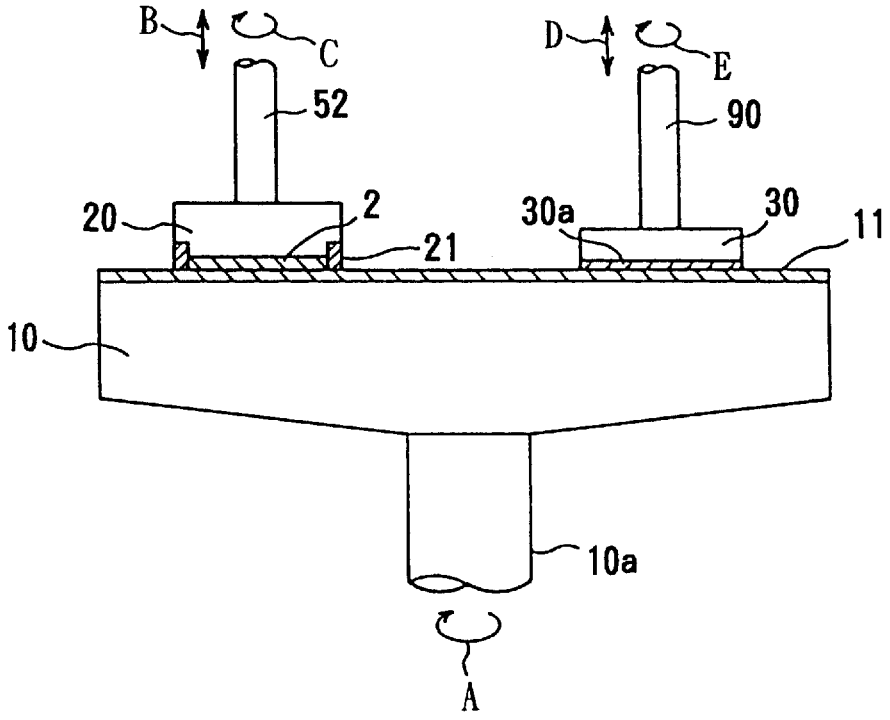
FIG. 1 is a front elevational view showing a basic structure of a polishing apparatus according to a first embodiment of the present invention.

FIG. 1 shows the basic structure of a polishing apparatus. As shown in FIG. 1, the polishing apparatus comprises a turntable 10, and a top ring 20 positioned above the turntable 10 for holding a semiconductor wafer 2 against the turntable 10. The top ring 20 is located in an off-center position with respect to the turntable 10. The turntable 10 is rotatable about its own axis as indicated by the arrow A by a motor (not shown) which is coupled through a shaft 10*a* to the turntable 10. A polishing cloth 11 is attached to an upper surface of the turntable 10.

The top ring 20 is coupled to a motor (not shown) and also to a lifting/lowering cylinder (not shown). The top ring 20 is vertically movable and rotatable about its own axis as indicated by the arrows B, C by the motor and the lifting/lowering cylinder. The top ring 20 can therefore press the semiconductor wafer 2 against the polishing cloth 11 under a desired pressure. The semiconductor wafer 2 is attached to a lower surface of the top ring 20 under a vacuum or the like. A guide ring 21 is mounted on the outer circumferential edge of the lower surface of the top ring 20 for preventing the semiconductor wafer 2 from being disengaged from the top ring 20.

A dressing unit comprises a dressing tool 30 which is positioned above the turntable 10 in diametrically opposite relation to the top ring 20. The dressing tool 30 is coupled to a motor (not shown) and also to a lifting/lowering cylinder (not shown). The dressing tool 30 is vertically movable and rotatable about its own axis as indicated by the arrows D, E by the motor and the lifting/lowering cylinder. The dressing tool 30 has a dressing layer 30*a* composed of, for example, a diamond grain layer containing diamond grains on its lower surface.

Figure 2:
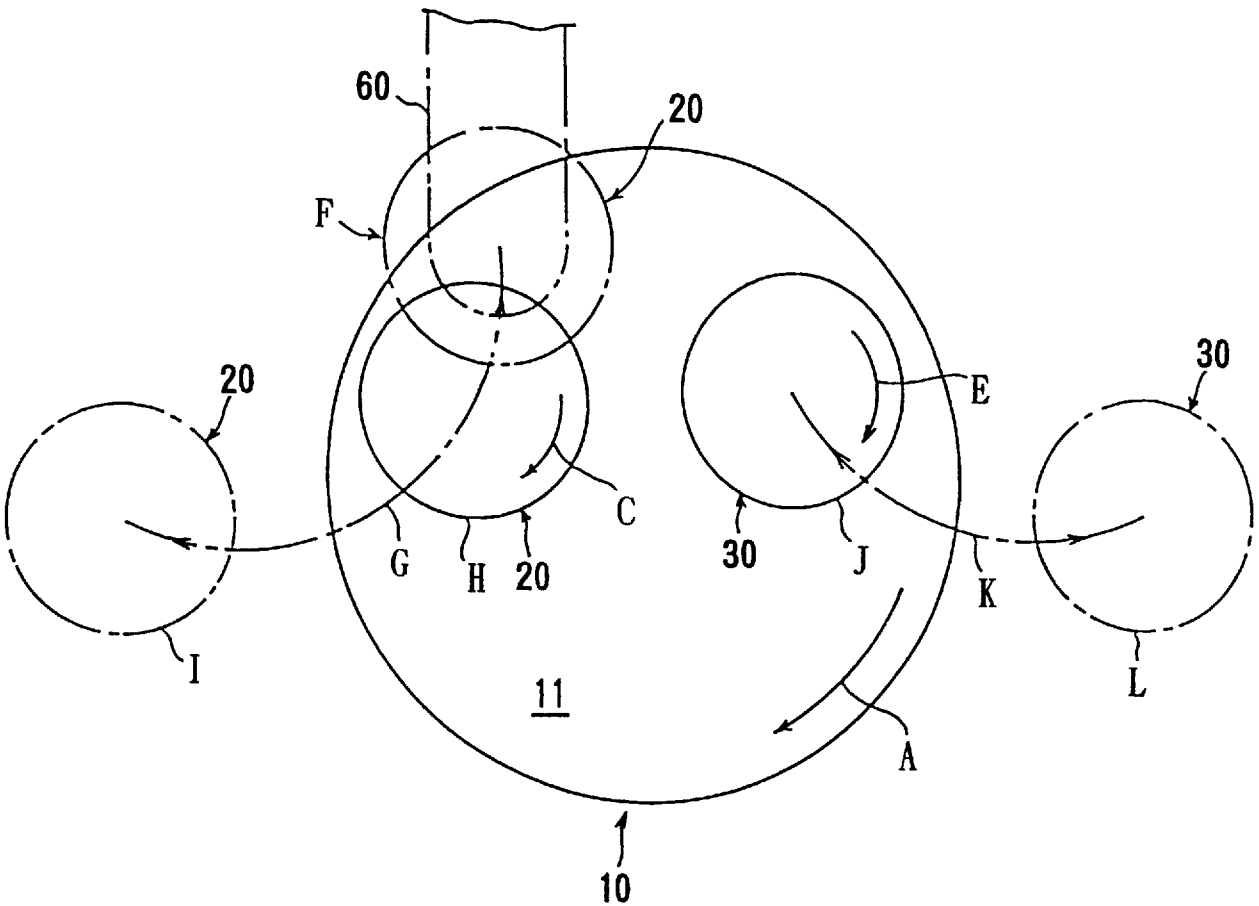
FIG. 2 is a plan view of a polishing apparatus shown in FIG. 1.

FIG. 2 is a schematic plan view showing the polishing apparatus shown in FIG. 1. As shown in FIG. 2, the polishing apparatus comprises the turntable 10 at a central part thereof, the top ring 20 and the dressing tool 30 which are disposed above the turntable 10. A semiconductor wafer 2 as a workpiece held by the lower surface of the top ring 20 is pressed against the polishing cloth 11 on the turntable 10, and the surface of semiconductor wafer 2 is polished to a flat mirror finish while the top ring 20 and the turntable 10 are rotated. The polishing process comes to an end when the semiconductor wafer 2 is polished by a predetermined thickness of a surface layer thereof. When the polishing process is completed, the polishing properties of the polishing cloth 11 are changed and the polishing performance of the polishing cloth 11 deteriorates. Therefore, the polishing cloth 11 is dressed by the polishing tool 30 to restore its polishing properties. The dressing tool 30 which rotates in a direction indicated by the arrow E is pressed against the rotating polishing cloth 11 on the turntable 10 so that the dressing layer 30*a* is brought in contact with the polishing cloth 11. The turntable 10 and the dressing tool 30 are rotated relatively to each other for thereby dressing the polishing cloth 11 to recover its original polishing capability.

In the polishing apparatus, as shown in FIG. 2, the top ring 20 receives the semiconductor wafer 2 from a robot arm 60 or a pusher (not shown) at a transferring position F, moves to a position above the turntable 10 through a path G, and then presses the semiconductor wafer 2 against the polishing cloth 11 to polish the semiconductor wafer 2 at a polishing position H. After the polishing process finishes, the top ring 20 is returned to the transferring position F through the path G, and the semiconductor wafer 2 which has been polished is transferred from the top ring 20 to the robot arm 60 or a pusher (not shown). Thereafter, the top ring 20 receives a new semiconductor wafer to be polished from the robot arm 60 or a pusher, moves to the polishing position H, and the semiconductor wafer 2 is polished at the polishing position H in the same manner as the above. The above processes are repeated until polishing processes of one lot of semiconductor wafers are completed. After polishing processes of one lot of the semiconductor wafers are completed, the top ring 20 is held in the transferring position F until another lot of semiconductor wafers are carried in. A position I which is located on the path G of the top ring 20 and adjacent to the turntable 10 is a standby position of the top ring 20 for maintenance.

On the other hand, the dressing tool 30 is pressed against the polishing cloth 11 on the turntable 10 at a dressing position J to dress the polishing cloth 11, thus recovering the original polishing capability cloth 11. After dressing, the dressing tool 30 moves to a standby position L which is located on a path K of the dressing tool 30 and adjacent to the turntable 10, and is held in the standby position L until the next polishing process finishes.

Figure 3:
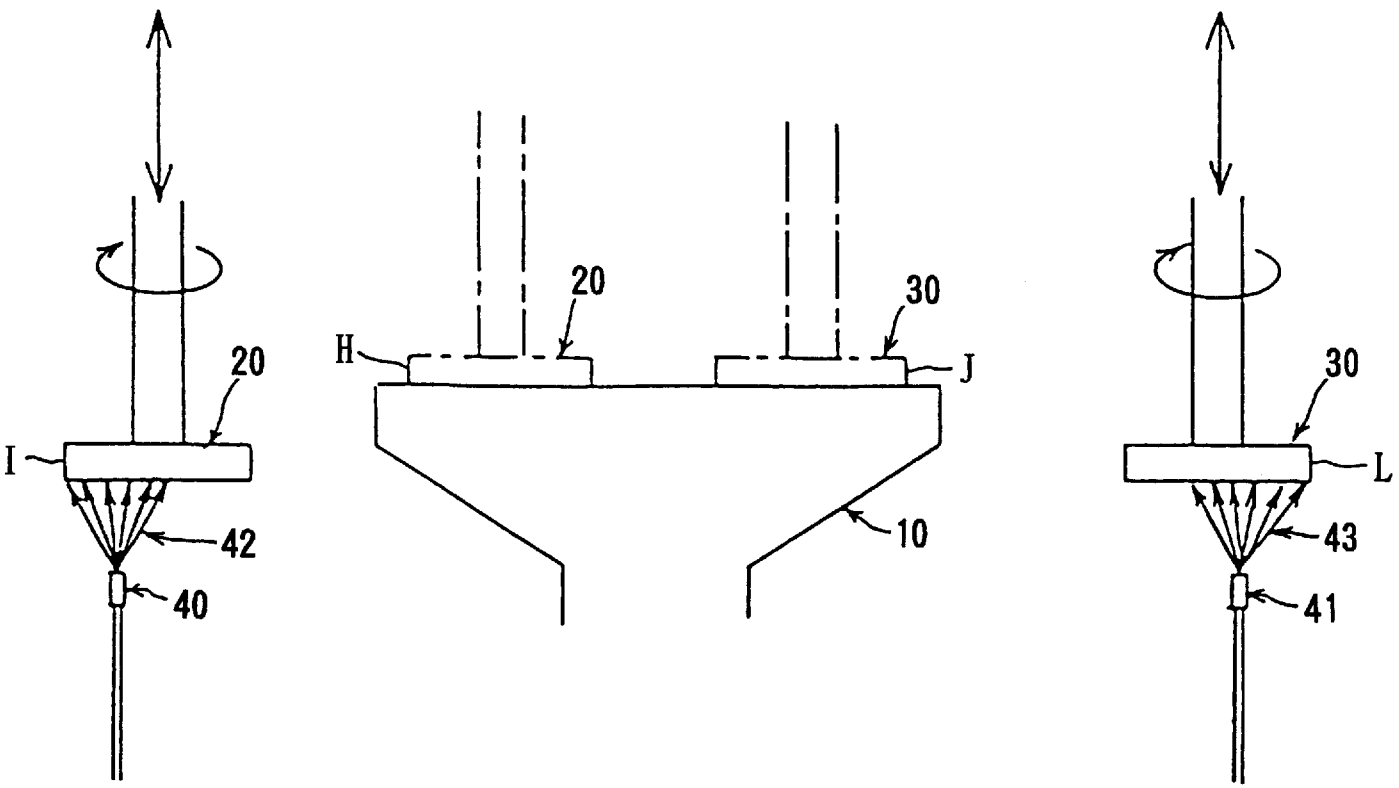
FIG. 3 is a front elevational view of a polishing apparatus according to the first embodiment of the present invention.

FIG. 3 shows the top ring 20 and the dressing tool 30 of the polishing apparatus which are held in standby positions I and L, respectively according to a first embodiment of the present invention. As shown in FIG. 3, the polishing apparatus has a cleaning liquid nozzle 40 positioned below the top ring 20 which is held in the standby position I for maintenance. The cleaning liquid nozzle 40 supplies cleaning liquid 42 such as pure water to a lower surface of the top ring 20 while the top ring 20 is held in the standby position I. The polishing apparatus shown in FIG. 3 also has a cleaning liquid nozzle 41 positioned below the dressing tool 30 which is held in the standby position L. The cleaning liquid nozzle 41 supplies cleaning liquid 43 such as pure water to a lower surface of the dressing tool 30 while the dressing tool 30 is held in the standby position L.

In the polishing apparatus having the above structure, while the top ring 20 is held in the standby position I for maintenance, the cleaning liquid 42 is supplied to the lower surface of the top ring 20 from the cleaning liquid nozzle 40 to thus keep the lower surface of the top ring 20 wet. At this time, by rotating the top ring 20, it is possible to keep the lower surface of the top ring 20 wet uniformly in its entirety.

While the dressing tool 30 is held in the standby position L, the cleaning liquid 43 is supplied to the lower surface of the dressing tool 30 from the cleaning liquid nozzle 41 to thus keep the lower surface of the dressing tool 30 wet. At this time, by rotating the dressing tool 30, it is possible to keep the lower surface of the dressing tool 30 wet uniformly in its entirety.

Since supply of the cleaning liquid 42 and 43 from the cleaning liquid nozzles 40 and 41 is primarily for the purpose of keeping the lower surfaces of the top ring 20 and the dressing tool 30 wet, the cleaning liquid 42 and 43 may continuously be supplied to the top ring 20 and the dressing tool 30, respectively while the top ring 20 and the dressing tool 30 are held in the respective standby positions I and L. However, in order to save the cleaning liquid 42 and 43, they may intermittently be ejected from the nozzles 40 and 41 at appropriate intervals selected not to allow the lower surfaces of the top ring 20 and the dressing tool 30 to be dried. Such intermittent ejection can save the cleaning liquid 42 and 43 comprising pure water (deionized water) or the like which is expensive.

In the embodiment shown in FIG. 3, the lower surfaces of the top ring 20 and the dressing tool 30 are cleaned by the cleaning liquid 42 and 43 supplied from the cleaning liquid nozzle 40 and the cleaning liquid nozzle 41. However, these cleaning liquid nozzles may be arranged to keep other portions such as side surfaces, in addition to the lower surfaces of the top ring 20 and the dressing tool 30, wet. Further, a plurality of cleaning liquid nozzles may be provided in each of the standby positions I and L.

Figure 4:
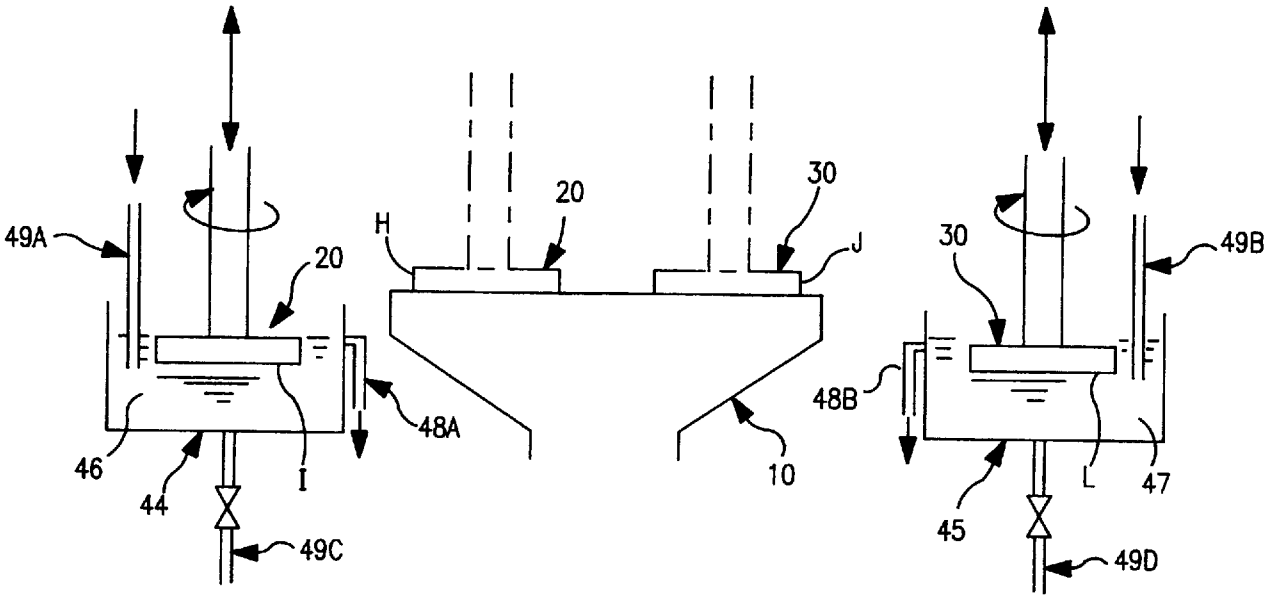
FIG. 4 is a front elevational view of a polishing apparatus according to a second embodiment of the present invention.

FIG. 4 shows the top ring 20 and the dressing tool 30 of the polishing apparatus which are held in standby positions I and L, respectively according to a second embodiment of the present invention. As shown in FIG. 4, the polishing apparatus has a container 44 filled with cleaning liquid 46 positioned at standby position I in which the top ring 20 is held for maintenance, and a container 45 filled with cleaning liquid 47 positioned at standby position L in which the dressing tool 30 is held.

In the polishing apparatus having the above structure, while the top ring 20 is held in the standby position I for maintenance, the top ring 20 is immersed in the cleaning liquid 46 in the container 44 to thus keep a certain portion such as a side surface, in addition to a lower surface of the top ring 20, wet. At this time, by rotating the top ring 20, the top ring 20 can effectively be cleaned. While the dressing tool 30 is held in the standby position L, the dressing tool 30 is immersed in the cleaning liquid 47 in the container 45 to thus keep a certain portion such as a side surface, in addition to a lower surface of the dressing tool 30, wet. At this time, by rotating the dressing tool 30, the dressing tool 30 can effectively be cleaned.

An overflow pipe 48A is provided on the container 44 for keeping the cleaning liquid 46 in the container 44 at a constant level, and the cleaning liquid 46 is supplied to the container 44 through a supply pipe 49A constantly at a small rate or intermittently, and hence the cleaning liquid 46 can be saved. Similarly, an overflow pipe 48B is provided on the container 45 for keeping the cleaning liquid 47 in the container 45 at a constant level, and the cleaning liquid 47 is supplied to the container 45 through a supply pipe 49B constantly at a small rate or intermittently, and hence the cleaning liquid 47 can be saved. Drain pipes 49C and 49D are provided on respective bottoms of the containers 44 and 45.

Inasmuch as the top ring 20 and the dressing tool 30 are immersed respectively in the cleaning liquid 46 and the cleaning liquid 47 while the top ring 20 and the dressing tool 30 are held respectively in the standby positions I and L, the top ring 20 and the dressing tool 30 can be kept wet more reliably than they are kept wet by the cleaning nozzles 40 and 41 shown in FIG. 3. Since the cleaning liquid 46 in the container 44 and the cleaning liquid 47 in the container 45 are not scattered around, they do not pollute a polishing room in which the polishing apparatus is installed, and they can be saved.

In the above embodiments in FIGS. 3 and 4, both the top ring 20 and the dressing tool 30 are kept wet in the respective standby positions I and L outside of the turntable 10. Therefore, any dry slurry is effectively prevented from being deposited on the top ring 20 and the dressing tool 30 and hence from dropping onto the polishing cloth 11 on the turntable 10. However, either one of the top ring 20 and the dressing tool 30 may be kept wet in some cases.

With the arrangements of the first and second embodiments of the present invention, as described above, since the polishing apparatus has a device for keeping the top ring and the dressing tool wet while the top ring and the dressing tool are held in the standby positions outside of the turntable, the top ring and the dressing tool are kept wet while they are in the standby positions, and can also be cleaned by the cleaning liquid supplied from the device. As a result, any dry slurry is prevented from being deposited on the top ring and the dressing tool and hence from dropping onto the polishing cloth on the turntable. In another aspect of this invention, in the case where a backing pad (elastic pad) is mounted to the lower surface of the top ring, by keeping the top ring wet, the wafer adheres more reliably to the lower surface of the top ring, hence the polishing performance is increased.

Figure 5:
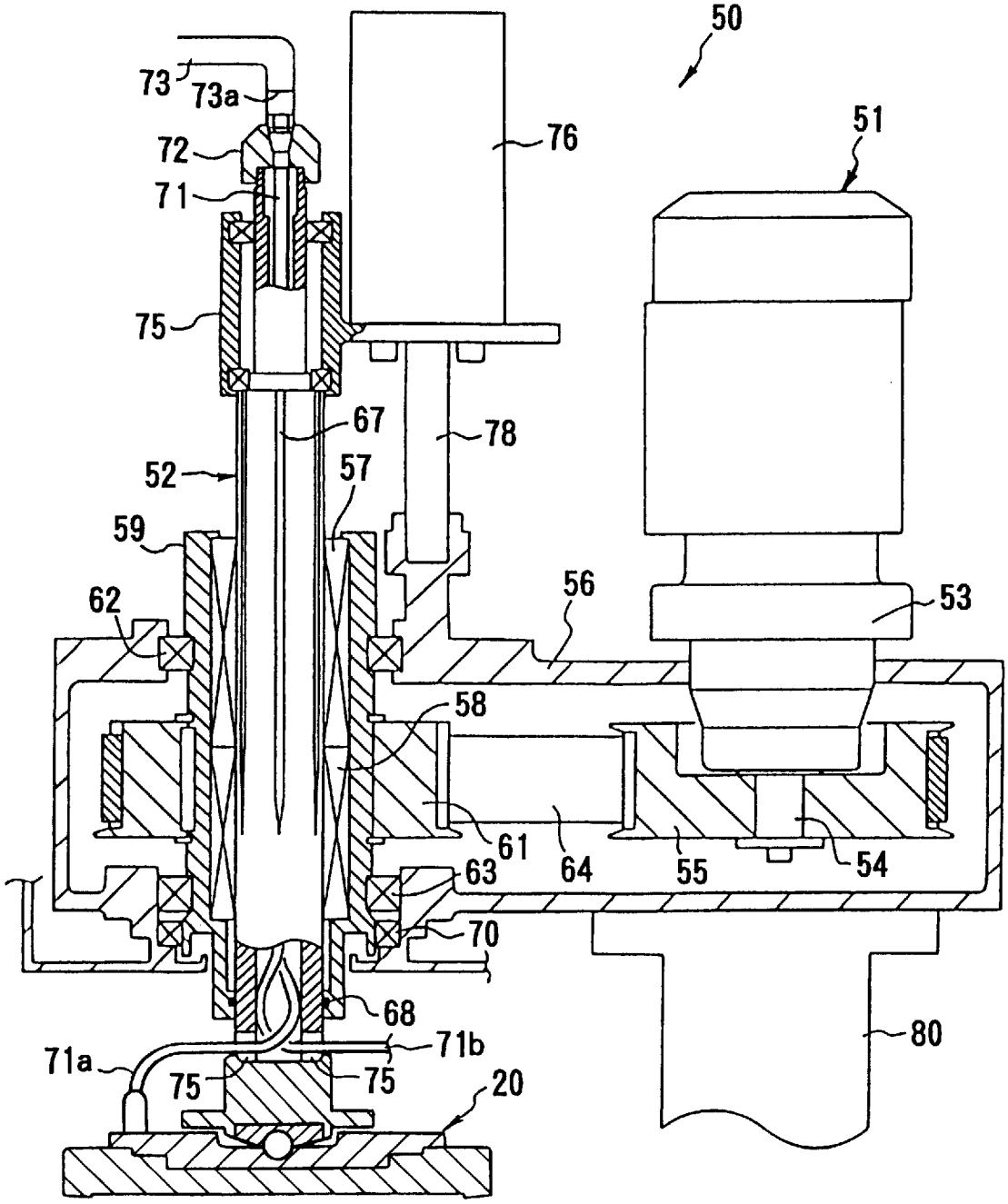
FIG. 5 is a cross-sectional view showing a top ring unit of the polishing apparatus according to the first and second embodiments of the present invention.
Figure 6:
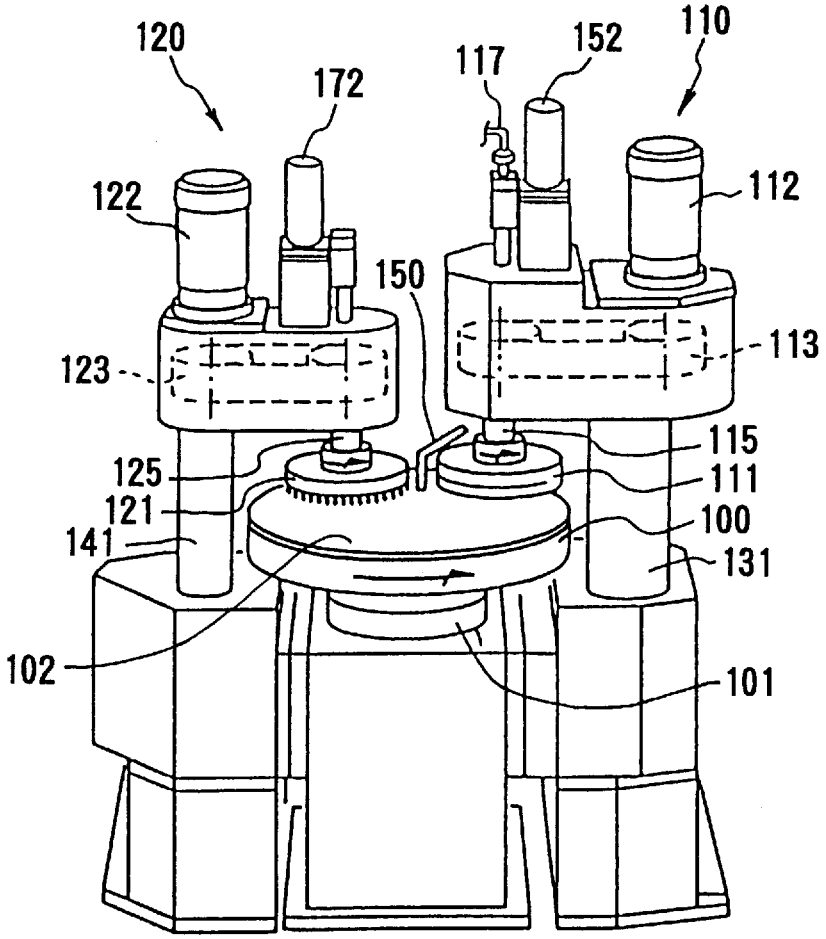
FIG. 6 is a perspective view of a conventional polishing apparatus.

FIG. 5 shows a detailed structure of a top ring unit incorporated in the polishing apparatus shown in FIGS. 1 through 4.

As shown in FIG. 5, a top ring unit 50 in the polishing apparatus generally comprises a motor 51, a top ring drive shaft 52 rotatable about its own axis by the motor 51, and a top ring 20 mounted on the lower end of the top ring drive shaft 52.

The motor 51 has its output shaft connected to a reduction gear 53 whose drive shaft 54 supports a pulley 55. The reduction gear 53 and hence the motor 51 are fixedly mounted on a case 56 which houses the pulley 55.

The top ring drive shaft 52 is of a hollow structure, and supports thereon a spline bushing 57 and a linear bushing 58 which are fitted thereover. A sleeve 59 is fixedly fitted over the spline bushing 57 and the linear bushing 58, and a pulley 61 is fixedly mounted on the sleeve 59. The sleeve 59 is rotatably supported by the case 56 through upper and lower bearings 62 and 63. A belt 64 is provided between the pulleys 55 and 61.

The spline bushing 57 is mounted through a bearing in spline grooves 67 defined axially in the outer circumferential surface of the top ring drive shaft 52. The spline bushing 57 and the top ring drive shaft 52 are rotatable integrally, but axially slidable relatively to each other. The linear bushing 58 supports the top ring drive shaft 52 so as to allow the top ring drive shaft 52 to rotate therein.

An annular seal 68 is provided between the inner circumferential surface of the lower end of the sleeve 59 and the outer circumferential surface of the top ring drive shaft 52. An oil seal 70 is disposed between the case 56 and the sleeve 59.

A pipe 71 is inserted into the upper end of the top ring drive shaft 52. The upper end of the pipe 71 is connected to a joint 72, and the upper end of the joint 72 is connected to a pipe 73. The pipe 73 is divided by a division line 73*a* into an upper portion, and a lower portion which is rotatable with the joint 72. The joint 72 is engaged to the drive shaft 52. The pipe 71 in the top ring drive shaft 52 is branched into two pipes 71*a* and 71*b* which extend out of the top ring drive shaft 52 through respective recesses 75 defined in the lower end of the top ring drive shaft 52 and which are connected to the top ring 20. The top ring 20 is connected to a vacuum source through the pipes 71 and 73 to develop a vacuum therein for attracting a semiconductor wafer to a lower surface thereof.

A cylinder bracket 75 is mounted on an upper end portion of the top ring drive shaft 52 in such a manner that the top ring drive shaft 52 is allowed to rotate with respect to the stationary cylinder bracket 75 and to move axially in unison with the cylinder bracket 75. An air cylinder 76 is fixed to the cylinder bracket 75, and has a rod 78 whose lower distal end is fixedly secured to the case 56. The case 56 is supported on the upper end of a supporting shaft 80.

The top ring drive shaft 52 is made of a hardened SUS440C, and has its entire outer circumferential surface coated with a wear-resistant synthetic resin.

In the illustrated embodiment, the wear-resistant synthetic resin comprises Teflon (trade mark) graphite synthetic resin. Specifically, a synthetic resin comprising a mixture of a powder of Teflon (fluorocarbon polymers) and a powder of graphite is sprayed onto the top ring drive shaft 52 in its entirety, and then baked to form a coated layer on the top ring drive shaft 52. The coated layer on the top ring drive shaft 52 has a thickness of about 5 $\mu$m.

The top ring drive shaft 52 thus coated has its increased corrosion resistance against the development of rust thereon.

Operation of the top ring unit 50 will be described below. First, a vacuum is developed in the top ring 20 through the pipes 73 and 71 to attract a semiconductor wafer to the lower surface of the top ring 20. Then, the motor 51 is energized to rotate the top ring drive shaft 52 through a transmission mechanism comprising the pulleys 54, 61 and the belt 64.

The top ring unit 50 is angularly moved by the supporting shaft 80 to move the top ring 20 above the rotating turntable 10. Thereafter, the air cylinder 76 is actuated to lower the air cylinder 76 and the cylinder bracket 75 with respect to the rod 78 fixed to the case 56, thereby lowering the top ring drive shaft 52 and the top ring 20 to press the semiconductor wafer against the polishing cloth 11 on the turntable 10. The lower surface of the semiconductor wafer is now polished by a combination of chemical polishing and mechanical polishing.

At this time, an abrasive liquid supplied to the polishing cloth is scattered around and applied to the top ring drive shaft 52. Since the top ring drive shaft 52 is coated with the wear-resistant synthetic resin, it does not develop rust by contact with the abrasive liquid.

Even when the wear-resistant synthetic resin is partly peeled off from the top ring drive shaft 52, it does not adversely affect the semiconductor fabrication environment as it is not metal.

After the semiconductor wafer is polished, the air cylinder 76 is actuated to raise the top ring drive shaft 52 and the top ring 20. Thereafter, the supporting shaft 80 is rotated to angularly move the top ring unit 50 to displace the top ring 20 outside of the turntable 10.

Although the present invention has been described as being applied to the top ring drive shaft 52, the principles of the present invention are also applicable to the dressing tool drive shaft 90 (see FIG. 1) for rotating the dressing tool 30 because a dressing liquid such as pure water supplied to dress the polishing cloth with the dressing tool is scattered around and applied to the dressing tool drive shaft 90.

The overall outer circumferential surface of the top ring drive shaft 52 is coated with the wear-resistant synthetic resin in the illustrated embodiment. However, the wear-resistant synthetic resin may be coated on at least the outer circumferential surface of the top ring drive shaft 52 in the vicinity of its lower end where the abrasive liquid is mainly apt to be applied. Specifically, the wear-resistant synthetic resin may be coated on only the exposed lower portion of the top ring drive shaft 52 which projects out of the lower end of the sleeve 59. This is because any liquid such as the abrasive liquid does not enter the case 56 and the portion of the top ring drive shaft 52 which projects upwardly from the case 56 is spaced away from the top ring 20, and hence the exposed lower portion of the top ring drive shaft 52 is most likely to develop rust. The same holds true for the dressing tool drive shaft 90 (see FIG. 1).

The wear-resistant synthetic resin coated on the top ring drive shaft 52 and/or the dressing tool drive shaft 90 may be any of various other synthetic resins other than the kind specified above.

With the arrangement of the present invention, as described above, the top ring drive shaft and/or the dressing tool drive shaft which are made of a hardened material and are not highly resistant to rust are prevented from developing rust, even when a liquid such as an abrasive liquid or pure water is applied. Since the top ring drive shaft and/or the dressing tool drive shaft are not plated with metal, but coated with the wear-resistant synthetic resin, they will not cause a metal contamination in the semiconductor fabrication process. In the embodiments, the standby positions of the top ring and the dressing tool are located at the outside of the turntable, however they may be located on or above the turntable.

Although certain preferred embodiments of the present invention have been shown and described in detail, it should be understood that various changes and modifications may be made therein without departing from the scope of the appended claims.

What is claimed is:

1. A polishing apparatus comprising:

a turntable having a polishing surface thereon;

a top ring for holding a workpiece to be polished and pressing the workpiece against said polishing surface on said turntable, said top ring being movable. between a polishing position inside of said turntable and a standby position; and a first device for keeping at least a lower surface of said top ring wet while said top ring is in said standby position, said first device comprising one of a nozzle for supplying a cleaning liquid to at least said lower surface of said top ring, and a container filled with a cleaning liquid for immersing therein at least said lower surface of said top ring.

2. A polishing apparatus according to claim 1, further comprising:

a dressing tool for dressing said polishing surface on said turntable, said dressing tool being movable between a dressing position inside of said turntable and a standby position; and a second device for keeping at least a lower surface of said dressing tool wet while said dressing tool is in said standby position.

3. A polishing apparatus according to claim 2, wherein said second device comprises one of a nozzle for supplying a cleaning liquid to at least said lower surface of said dressing tool, and a container filled with a cleaning liquid for immersing therein at least said lower surface of said dressing tool.

4. A polishing apparatus according to claim 3, wherein said nozzle intermittently ejects said cleaning liquid.

5. A polishing apparatus according to claim 2, wherein said dressing tool is rotated while at least said lower surface thereof is kept wet by said second device.

6. A polishing apparatus according to claim 2, further comprising:

a dressing liquid supply device for supplying a dressing liquid to said polishing surface on said turntable; and a dressing tool drive shaft for rotating said dressing tool, said dressing tool drive shaft having a lower portion where the dressing liquid tends to be applied, at least said lower portion of said dressing tool drive shaft being coated with a wear-resistant synthetic resin.

7. A polishing apparatus according to claim 6, wherein said wear-resistant synthetic resin comprises a mixture of a powder of fluorocarbon polymers and a powder of graphite.

8. A polishing apparatus according to claim 1, wherein said nozzle intermittently ejects said cleaning liquid.

9. A polishing apparatus according to claim 1, wherein said top ring is rotated while at least said lower surface thereof is kept wet by said first device.

10. A polishing apparatus according to claim 1, further comprising:

an abrasive liquid supply device for supplying an abrasive liquid to said polishing surface on said turntable; and a top ring drive shaft for rotating said top ring, said top ring drive shaft having a lower portion where the abrasive liquid tends to be applied, at least said lower portion of said top ring drive shaft being coated with a wear-resistant synthetic resin.

11. A polishing apparatus according to claim 10, wherein said wear-resistant synthetic resin comprises a mixture of a powder of fluorocarbon polymers and a powder of graphite.

12. A polishing apparatus comprising:

a turntable having a polishing surface thereon;

a top ring for holding a workpiece to be polished and pressing the workpiece against said polishing surface;

an abrasive liquid supply device for supplying an abrasive liquid to said polishing surface on said turntable;

a top ring drive shaft for rotating said top ring, said top ring drive shaft having a lower portion where the abrasive liquid tends to be applied, at least said lower portion of said top ring drive shaft being coated with a wear-resistant and corrosion-resistant synthetic resin comprising a mixture of a powder of fluorocarbon polymers and a powder of graphite;

a dressing tool for dressing the polishing surface on said turntable;

a dressing liquid supply device for supplying a dressing liquid to said polishing surface on said turntable; and a dressing tool drive shaft for rotating said dressing tool, said dressing tool drive shaft having a lower portion where the dressing liquid tends to be applied, at least said lower portion of said dressing tool drive shaft being coated with a wear-resistant synthetic resin.

13. A method for polishing a workpiece in a polishing apparatus including a turntable having a polishing surface thereon, and a top ring for holding a workpiece to be polished and pressing the workpiece against said polishing surface on said turntable, said top ring being movable between a polishing position inside of said turntable and a standby position, said method comprising:

moving said top ring to said standby position; and maintaining at least a lower surface of said top ring wet while said top ring is in said standby position and polishing of said workpiece is not performed.

14. A polishing apparatus comprising:

a turntable having a polishing surface thereon;

a top ring for holding a workpiece to be polished and pressing the workpiece against said polishing surface;

an abrasive liquid supply device for supplying an abrasive liquid to said polishing surface on said turntable; and a top ring drive shaft for rotating said top ring, said top ring drive shaft having a lower portion where the abrasive liquid tends to be applied, at least said lower portion of said top ring drive shaft being coated with a wear-resistant and corrosion-resistant synthetic resin comprising a mixture of a powder of fluorocarbon polymers and a powder of graphite.

* * * * *